US005410852A

United States Patent [19]

Edgar et al.

[11] Patent Number: 5,410,852

[45] Date of Patent: May 2, 1995

[54] EXTERIOR INSULATION AND FINISH SYSTEM

[75] Inventors: John R. S. Edgar, Toronto; Kenneth P. Wesley, Mississauga, both of Canada

[73] Assignee: STO Aktiengesellschaft, Stuhlingen, Germany

[21] Appl. No.: 95,373

[22] Filed: Jul. 23, 1993

[30] Foreign Application Priority Data

Jul. 28, 1992 [GB] United Kingdom ..... 9216029

[51] Int. Cl.[6] ..... E04B 5/00

[52] U.S. Cl. ..... 52/408; 52/515

[58] Field of Search ..... 52/309.8, 309.9, 309.11, 52/309.12, 408, 409, 410, 515, 62

[56] References Cited

U.S. PATENT DOCUMENTS 4,349,398 9/1982 Kearns et al. ..... 52/309.12 X 5,027,572 7/1991 Purcell et al. ..... 52/309.9

*Primary Examiner*—Carl D. Friedman

*Assistant Examiner*—Creighton Smith

*Attorney, Agent, or Firm*—Jacobson, Price, Holman & Stern

[57] ABSTRACT

An exterior insulation and finish system (14) for a building including an air-permeable insulation (28) located between an air barrier (20) and an exterior finish (31), a portion of one edge (24, 35*b*) of the insulation being exposed to permit air to flow into and out of the insulation to equalize pressures across the exterior finish.

13 Claims, 5 Drawing Sheets

EXTERIOR INSULATION AND FINISH SYSTEM

BACKGROUND OF THE INVENTION

The present invention relates to a system for insulating and finishing the exterior of a building.

Rain penetration is one of the oldest problems building owners have had to deal with yet it still occurs all too frequently. The penetration of rain not only can damage interior finishes and materials but it can also damage the structure of the walls themselves.

Rain penetration results when a combination exists of water at the surface of the wall, openings through which it can pass, and a force to move the water through these openings. The elimination of any one of these three conditions could prevent the occurrence of rain penetration. While wide roof overhangs may help to shelter the walls of a low-rise building, similar protection is not available to higher buildings. Therefore, one of the remaining two conditions must be eliminated to prevent rain penetration.

The face seal approach attempts to eliminate all the openings in the wall through which water can pass. However, the materials used to seal all these openings are exposed to extremes of weather and to movements of the building. Even if the problems of job site inaccuracies and poor workmanship can be overcome and a perfect seal can be achieved, the in-service weather conditions may eventually cause the deterioration and failure of these seals, creating openings in the wall through which water can pass. Unfortunately, these openings can be extremely tiny and difficult to identify, so that even an extensive maintenance program may not keep the building free of openings.

The alternate approach to controlling rain penetration is to eliminate the forces which drive or draw water into the wall. There are typically considered to be four such forces: kinetic energy, capillarity, gravity and wind pressure differences.

For a wind-driven rain storm, rain droplets can be blown directly into large openings in the wall. However, if there is no direct path to the interior, the rain droplets will not pass deeply into the wall. Where large openings, such as joints, are unavoidable, the use of battens, splines, baffles or overlaps has been successful in minimizing rain penetration caused by the kinetic energy of the rain drops.

Due to the surface tension of water, voids in a material will tend to draw in a certain amount of moisture until the material approaches saturation. If capillaries pass from the exterior to the interior, water can move through the wall due to the action of capillary suction. While partial water penetration of a wall by capillarity is characteristic of porous cladding material, the introduction of a discontinuity or air gap can prevent through-wall movement of water.

The force of gravity will cause water to move down the face of the wall and into any downward sloped passages into the wall. To prevent gravity induced movement through joints, they are typically designed to slope upwards from the exterior. Unintentional cracks or openings are more difficult to control. If there is a cavity directly behind the exterior face of the wall, any water that does flow through the wall will then be directed downward, by gravity, on the inboard face of the exterior wall. At the bottom of the cavity, the water can then be drained back to the outside through the use of sloped flashings.

An air pressure difference across the wall of a building is created by stack effect, wind and/or mechanical ventilation. If the pressure on the exterior face of the wall is higher than on the interior of the wall, water can be forced through tiny openings in the wall. Research has shown that the amount of rain moved through the cladding by this mechanism is the most significant. It has previously been recognized that this force can be eliminated or reduced by the use of the pressure-equalized cavity.

The theory of the pressure equalized cladding is that it neutralizes the air pressure difference across the cladding (caused by wind) which causes water penetration. It is impossible to prevent wind from blowing on a building but it is possible to counteract the pressure of the wind so that the pressure difference across the exterior cladding of the wall is close to zero. If the pressure difference across the cladding is zero, one of the main forces of rain penetration is eliminated.

In previous proposals, a rainscreen wall incorporates two layers or wythes separated by an air space or cavity. The outer layer or cladding is vented to the outside. When wind blows on the building facade, a pressure difference is created across the cladding. However, if the cavity behind the cladding is vented to the outside, some of the wind blowing on the wall enters the cavity, causing the pressure in the cavity to increase until it equals the exterior pressure. This concept of pressure equalization presupposes that the inner wythe of the wall is airtight. This inner wythe, which includes an air barrier, must be capable of sustaining the wind loads in order for pressure equalization to occur. If there are significant openings in the air barrier, the pressure in the cavity will not equalize and rain penetration may occur.

More recently, it has been recognized that optimum insulation of a building is obtained if the insulating material is applied to the exterior of the building. With the insulation on the outside of the building, thermal bridges due to structural components of the building are eliminated and a consistently high R value is provided.

The application of external insulation to a rainscreen wall has, however, led to practical difficulties due to the need to provide for the equalization of pressure within the cavity defined by the insulation and still comply with model building codes. The spacing of the insulation from either the load bearing structure or the cladding to define the cavity leaves one face of the insulation exposed. This is contrary to model building codes, such as, for example, the National Building Code of Canada (NBCC) which requires that combustible insulation must have all faces sealed. Therefore, this type of construction can only be used in applications that permit combustible construction, typically building under three stories high. As a result, external insulation has been used with face seal systems and rainscreen walls have been used with internal insulation.

BRIEF SUMMARY OF THE INVENTION

It is an object of the present invention to provide an exterior insulation rainscreen structure that obviates or mitigates the above disadvantages.

The present invention is based upon the recognition that a pressure equalization cavity can be defined by an air permeable insulation installed between the load supporting structure and the cladding and by making provision for air to flow to and from the cavity. This allows rapid equalization of pressures but also ensures that faces of the insulation are not exposed to an air cavity when installed.

BRIEF DESCRIPTION OF THE DRAWINGS

An embodiment of the invention will now be described in detail by way of example only, with reference to the accompanying drawings, wherein.

DETAILED DESCRIPTION

Figure 1:
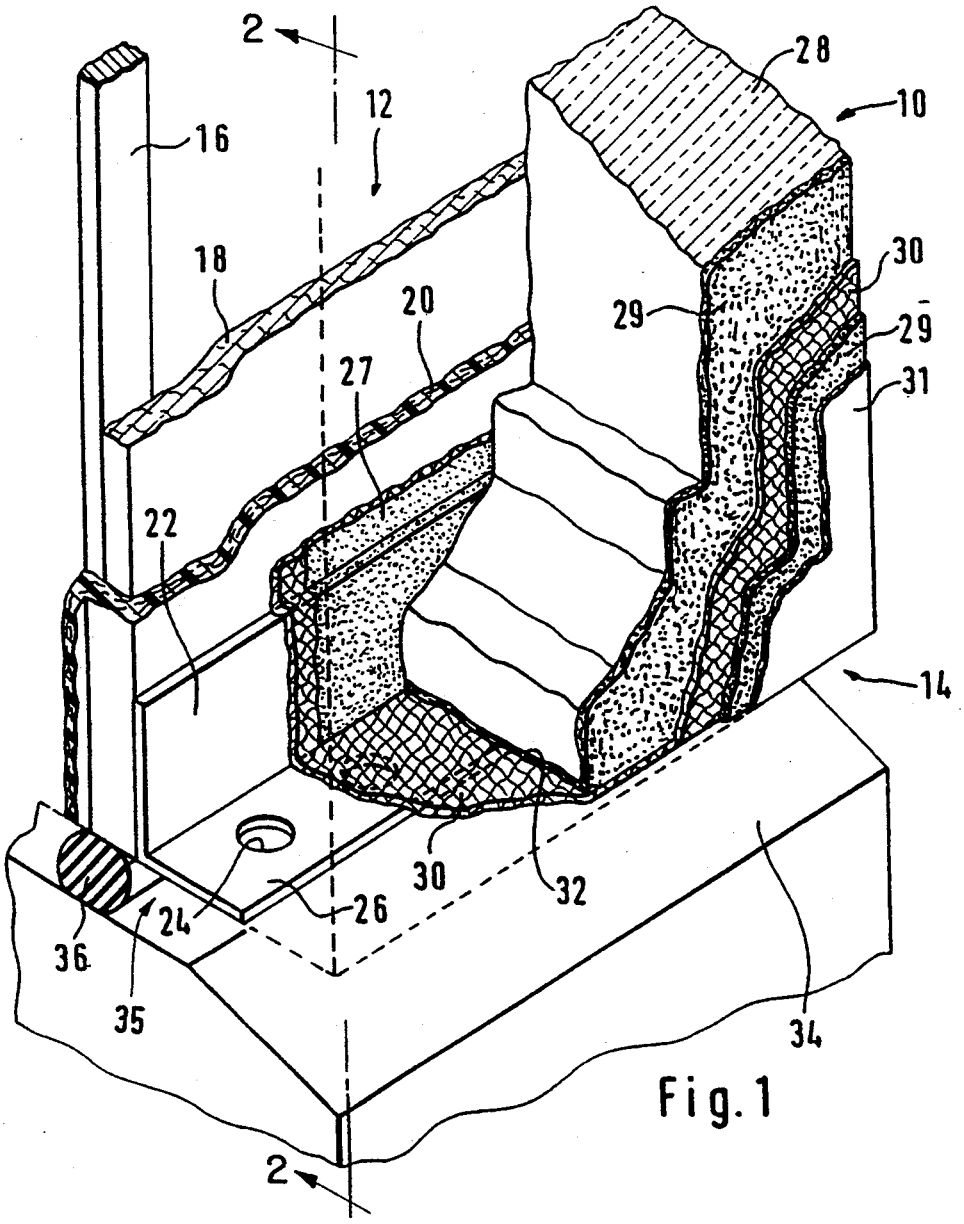
FIG. 1 is a perspective isometric view partially broken away of a building wall.

Referring to FIG. 1, a wall of a building indicated at 10 includes a load-bearing structure 12 and an exterior insulation and finish system (EIF) 14. The load-bearing structure 12 includes vertical load-bearing studs 16 spaced at regular intervals and a sheathing 18 secured to the studs 16. The load-bearing structure 12 may of course be in any suitable form, including concrete block, structural steel or the like.

An airtight barrier 20 is applied over the sheathing 18 that will meet the NRC Institute for Research and Construction guidelines for a Type III Air Barrier. A material suitable for this is a product known as Sto Flexyl reinforced with Sto Airbarrier Mesh, both available from Sto Industries Canada Inc., Mississauga, Ontario.

The EIF system 14 may be applied after the load supporting structure 12 has been installed in the building or may be prefabricated as panels including the load supporting structure which are than installed on the building. In each case, however, the formation of the EIF system 14 is similar and will result in a unitary structure covering a defined area such as a wall, part of a wall or a discrete panel having defined edges. For convenience, the term "panel" will be used to refer to the unitary structure with it being understood that such a term is not limited to a separate, prefabricated unit. The EIF system 14 consists of a layer of insulation 28 and a lamina 27 comprising a base coat 29, a fiberglass reinforcing mesh 30 and a finish coat 31. The base coat 29 and finish coat 31 cover the exposed surfaces of each panel to prevent moisture entering the insulation 28 and the mesh 30 provides reinforcement to prevent cracking of the coats 29,31.

Figure 2:
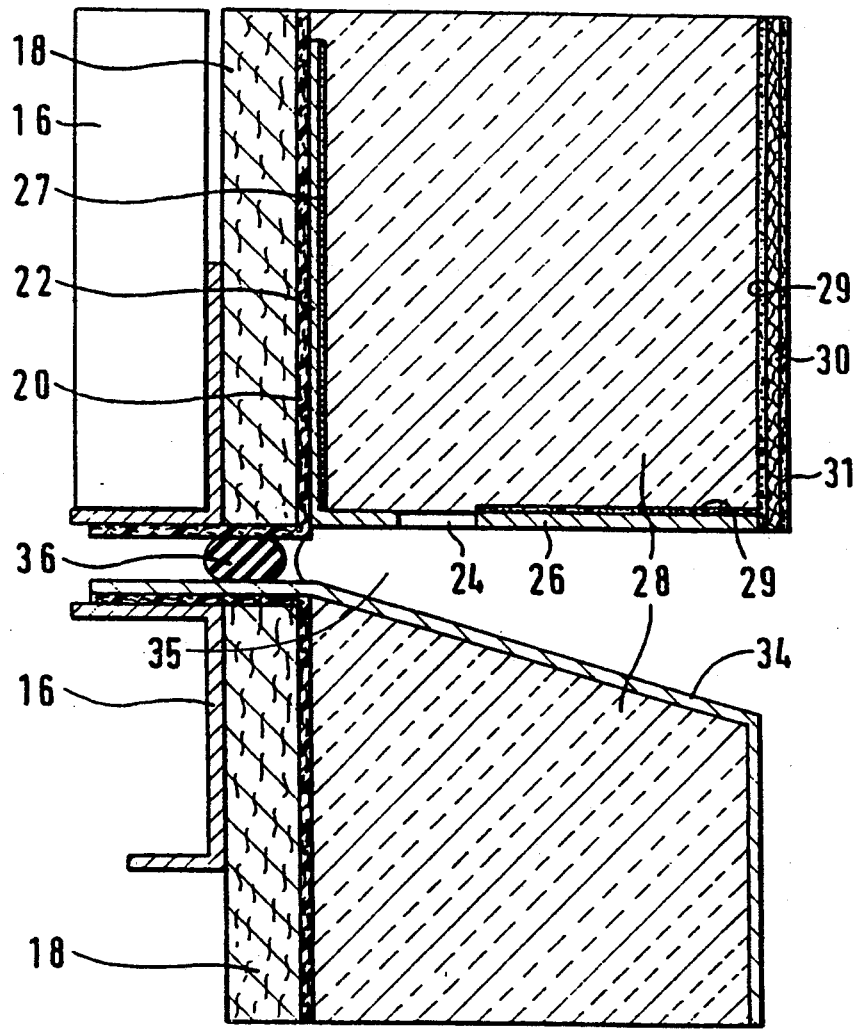
FIG. 2 is a cross-sectional view taken on line 2—2 of FIG. 1, with FIGS. 2*a* and 2*b* showing alternative embodiments.

As may be seen from FIGS. 1 and 2, angle member 22 is secured to the sheathing 18 so as to be located along the bottom edge 34 of the insulation 28. The angle member 22 has apertures 24 provided in its horizontal limb 26. The apertures 24 provide a vent area greater than 1% of the panel area and so for a four-foot high panel, eight one-inch diameter holes per foot are required along the member 22. A vent area greater than 1%–2% of the frontal area of the system 14 is found acceptable.

To form the EIF system 14, strips of fibreglass reinforcing mesh 30 are first applied around the periphery of the panel, i.e. the area to be covered by the insulation 28, to facilitate the covering of the exposed edges of the insulation. An insulation board 28 is than applied over the sheathing 18 to cover the area of the panel and is secured to the air barrier 20 by a suitable adhesive 27, preferably non-combustible. Suitable adhesive is Sto BTS-NC, available from Sto Industries Canada Inc. The insulation 28 is a suitable air permeable insulation material that has sufficient compressive and tensile strength to support the coatings 29,31. It has been found that Roxul External Wall Lamellas insulation, which is a mineral wool insulation having a density of 6 lb per cubic foot, is suitable for this purpose.

Figure 3:
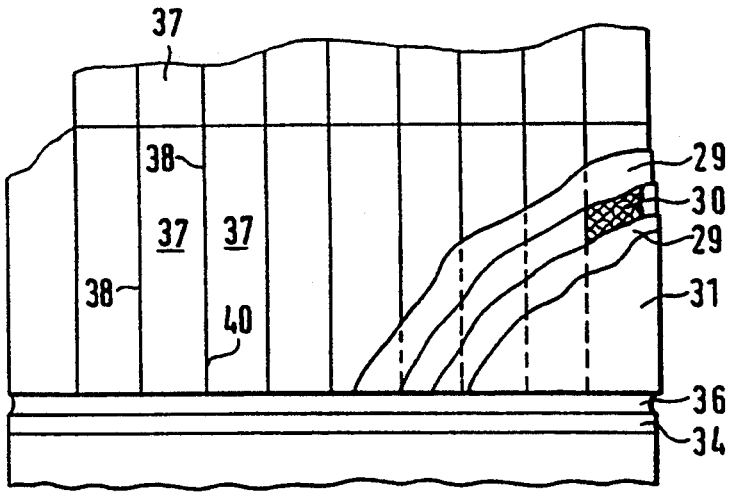
FIG. 3 is a front elevation of the wall shown in FIG. 1.

The Roxul External Wall Lamellas insulation may be applied in various thickness of 2, 3 or 4 inches, depending upon the degree of insulation required and typically is supplied in individual boards 37 having dimensions 6"×48" which are applied to the load supporting structure 12 to cover the desired area. The boards 37 are oriented so their longitudinal edges 38, that is the 48" edge, are disposed vertically providing a vertical joint indicated at 40 between adjacent boards 37 and extending to the angle member 22. Although the narrow edges of the boards 36 are shown aligned in FIG. 3, it is conventional to stagger the narrow edges vertically to mitigate the formation of cracks. The Roxul External Wall Lamellas insulation consists of mineral wool fibres with approximately 10% mineral wool and 90% or greater air by volume. The fibers are arranged in the board 36 to extend between the major faces of the board so that when installed, the majority of fibers are perpendicular to the cladding 18. This arrangement provides the necessary compressive and tensile strengths while providing a relatively permeable insulation through which air can flow in a direction parallel to the cladding 18.

All the exposed faces and edges of the insulation 28, except the portion of its lower edge 32 that is supported on the angle member 22, are then coated with a non-combustible base coat 29 with an average thickness of ⅛th of an inch. A suitable base coat is Sto BTS-NC which is a polymer modified Portland cement-based coating that provides adhesion to the insulation and support for decorative finishes. The base coat 29 is reinforced by the fiberglass reinforcing mesh 30 which is treated to be alkali resistant and which is embedded into the base coat 29 while it is still wet. The reinforcing mesh 30 is wrapped and embedded at the exposed edges of the insulation in accordance with normal installation procedures. The mesh 30 also extends across the lower edge 32 but no coating is applied to the portion covered by the horizontal limb 26 of angle member 22 to define a slot 35 so that air may move freely to and from the board 28 through the holes 24. The angle member 22 thus protects a portion of the lower edge 32 while allowing air flow into the insulation. The base coat 29 and embedded mesh 30 may then be covered with a finish coat 31 of any of the standard synthetic stucco primers and finishes that are available from Sto Industries Canada Inc. for finishing in the desired manner.

Figure 4A:
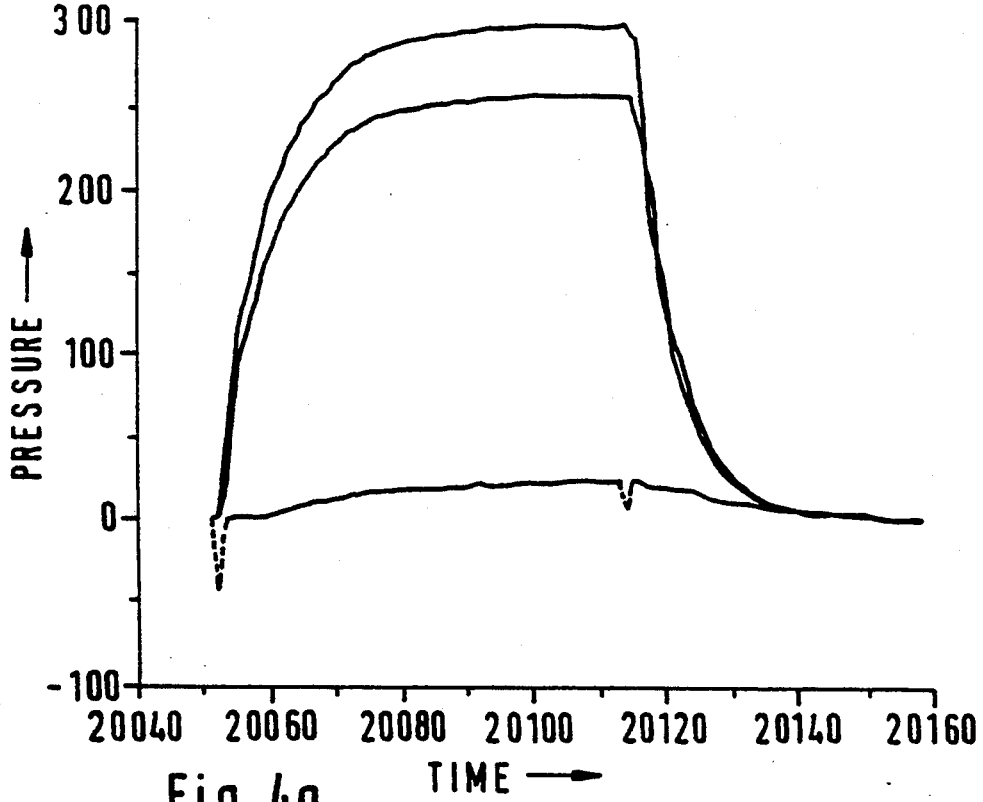
FIGS. 4*a* and 4*b* are curves showing the response to changes in pressure on the exterior and interior (respectively) of the wall shown in FIG. 1.
Figure 4B:
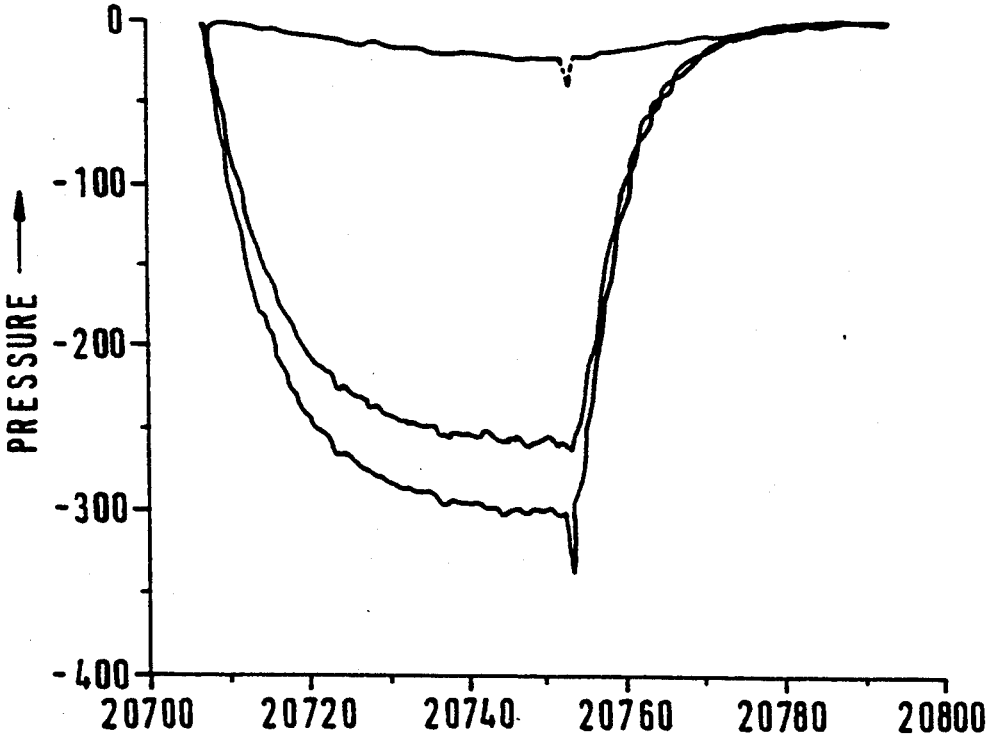
Figure 5:
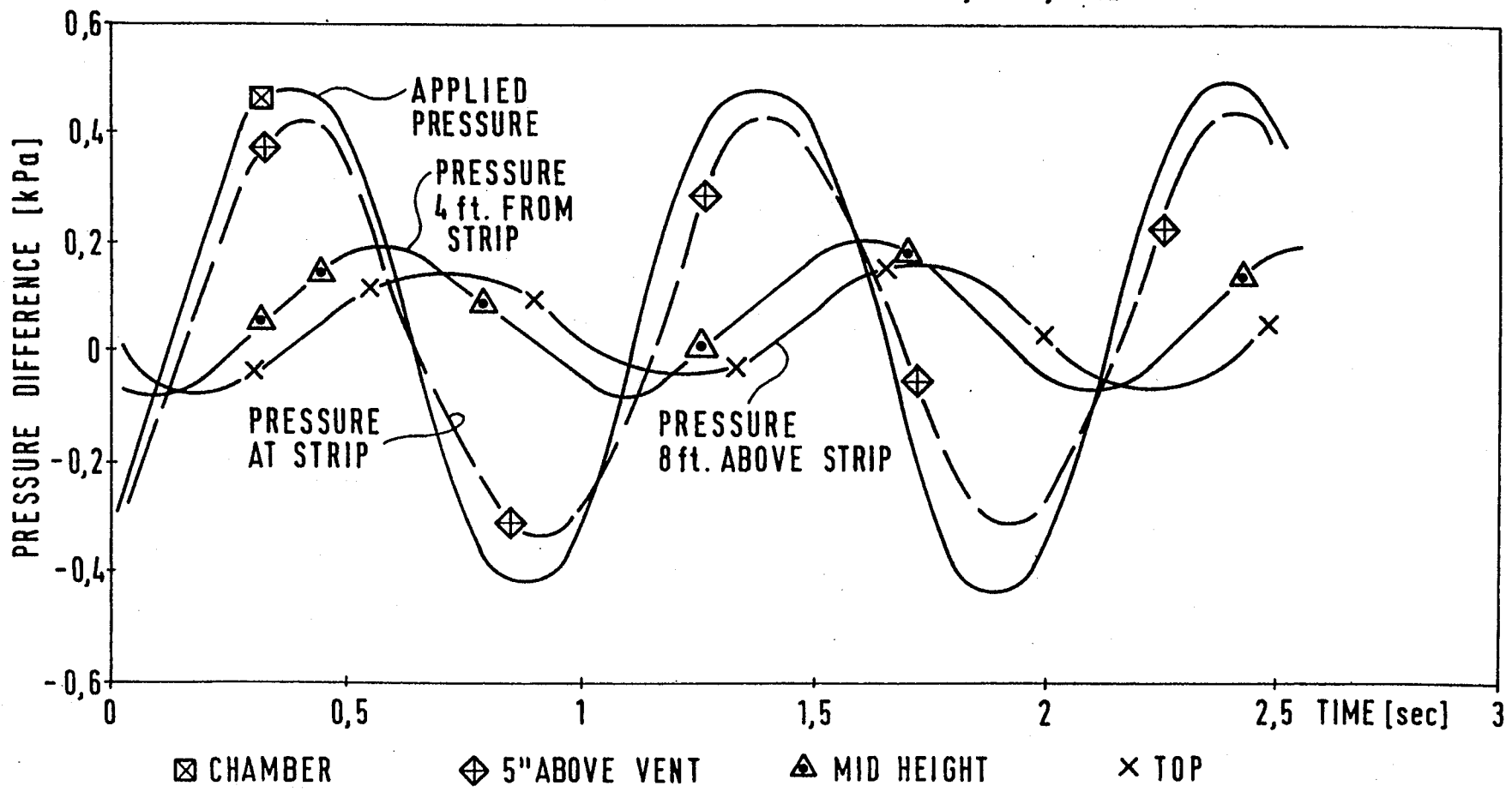
FIG. 5 is a graphical representation of a further set of tests performed on the panel of FIG. 1.

The holes 24 in the angle member 22 permit air movement into and out of the insulation board 28. As can be seen in FIGS. 4*a* and 4*b*, which show experimental results obtained with the arrangement shown in FIG. 1 on a test panel subjected to a progressive pressure increase over an extended period, an increase in the exterior pressure as indicated by the solid black line is closely followed by an increase in the interior pressure indicated by the broken line. This is particularly true at the lower values of the pressure increase which are more typical of those that would be experienced in real conditions. Similarly, a reduction in pressure as demonstrated in FIG. 4*b* causes the exterior and interior pressures to follow one another. The immediate equalization of pressure is significant as the pressure forces are usually transient due to wind gusting and a delay in pressure equalization would permit pressure differentials to exist and allow moisture to pass through the finish coat. As shown in FIG. 5, which indicates results obtained with the panel of FIG. 1 subjected to a cyclical dynamic pressure change, the pressure within the insulation 28 follows closely the applied external pressure over a majority of the panel.

In this manner, a significant pressure differential across the lamina will not exist and so water will not be forced through the lamina into the insulation. This permits the insulation 28 to be applied directly against the air barrier 20 without any provision for drainage or a cavity.

The orientation of the fibers in the insulation 28 is believed to promote the rapid dissemination of pressure surges over the area covered by the insulation board. This is enhanced by the vertical orientation of the joints 40 which allows air to move vertically along each board 37 and into the body of the insulation to assist in the distribution of air and hence pressure equalization. If necessary each edge 38 can be formed with a longitudinal recess extending along the length of the board 37 so that abutting edges 38 define a channel extending vertically to promote air flow. This may be beneficial where the EIF system utilizes panels with larger vertical dimensions.

Figure 2A:
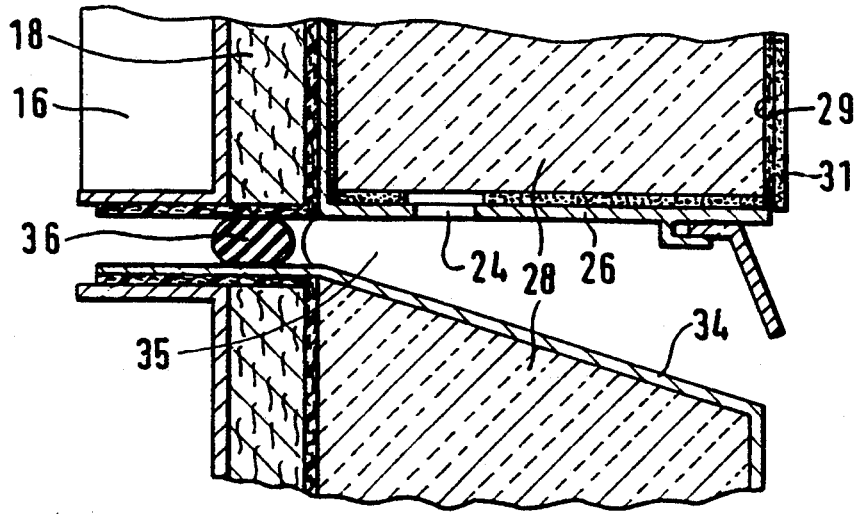

It is anticipated that the support channel 22 may be extended to provide protection for the underside of the insulation and may carry a drip edge as shown in FIG. 2*a* to provide further protection for the lower edge of the panel.

Where the EIF system 14 is prefabricated with the load supporting structure 12, a caulking strip 36 is used to seal between adjacent prefabricated sections. In this case, it is preferred (as shown in FIGS. 1 and 2) that the upper edge 34 of each section is sloped downwardly to assist drainage away from the caulking strip 36.

Figure 2B:
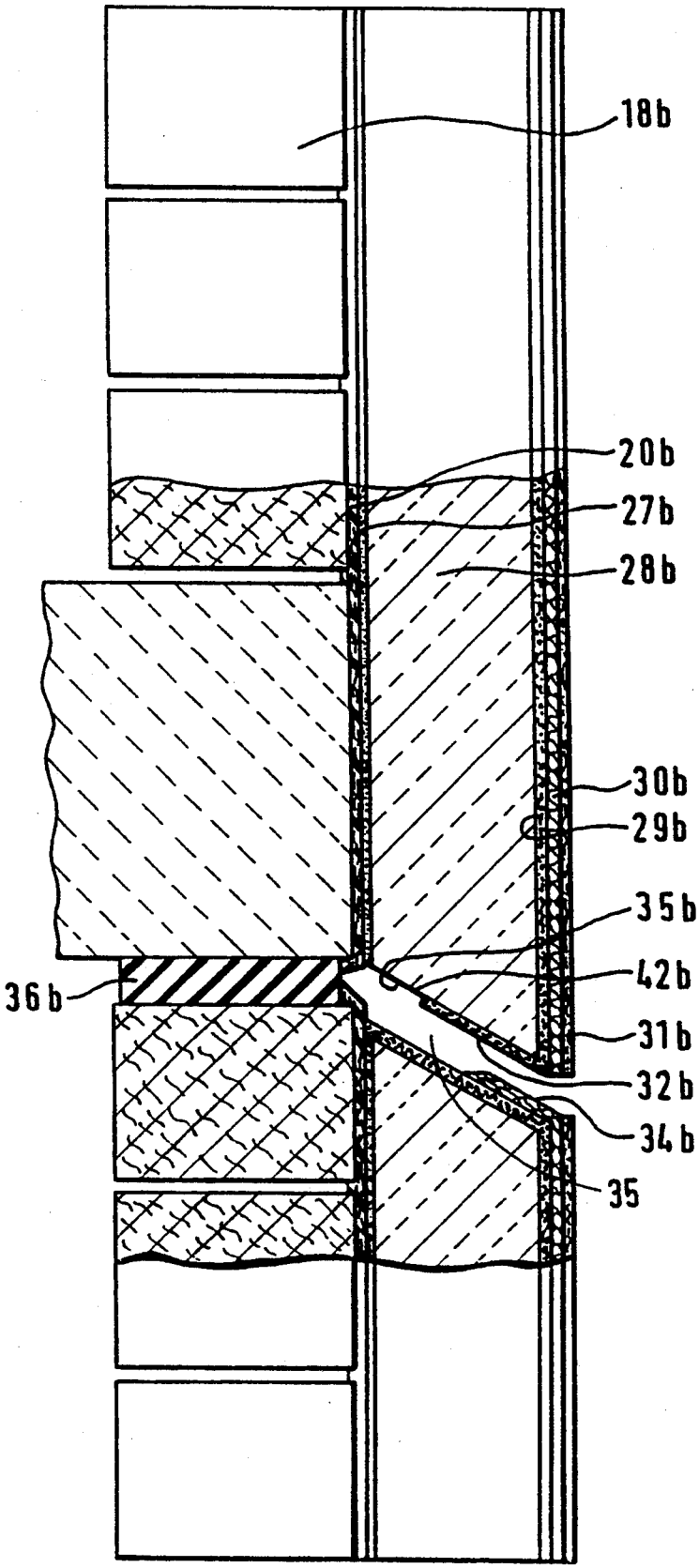

A further embodiment that does not use a support strip 22 is shown in FIG. 2*b* where a suffix '*b*' will be used to denote like components. In the embodiment of FIG. 2*b*, the lower edge 32*b* of one panel and top edge 34*b* of an adjacent panel are spaced from one another and are downwardly and outwardly inclined at an approximately 30° angle. The lower edge 32*b* is covered with reinforcing mesh 30*b* but only the outer portion of the edge 32*b* is coated with the base coat 29*b* to define a slot 35*b* and leave an exposed strip 42. The lower edge of the insulation 28*b* is thus open and air may flow freely into and out of the insulation 28*b* along its lower edge 32. In practice, it has been found that the width of the slot 35*b* should provide an area of 1%–2% of the face area of the panel. Thus for a panel 8 foot high, the slot 35*b* should be between 1" and 2" wide.

It is believed that the mineral wool insulation identified in the example given above provides for maximum response to changes in air pressure but other forms of insulation may be used provided they do not allow a substantial air pressure differential to be maintained between the interior and exterior of the insulation.

We claim:

1. An exterior insulation and finish system for application to a wall of a building comprising:

an air barrier having a pair of oppositely directed surfaces, one of which contacts said wall and a second of which is directed outwardly from said wall;

an insulation material having first and second oppositely directed faces, said first face abutting said second surface of said barrier to cover a predetermined area of said wall;

said insulation material being permeable and having peripheral edges extending between said first and second faces and delimiting the area to be covered by said exterior insulation; and an exterior finish applied to said second face, at least one of said peripheral edges and at least part of one other of said edges to inhibit ingress of said moisture into said insulation, so that at least a portion of said one other of said peripheral edges remains uncovered by said exterior finish to permit air to flow into said insulation and equalize pressure across said exterior finish.

2. An exterior finish and insulation system as claimed in claim 1 wherein:

said insulation material comprises fibrous material having fibers thereof orientated to extend between said first and second faces.

3. An exterior finish and insulation system as claimed in claim 2 wherein:

said insulation material further comprises:

a plurality of boards having adjacent edges abutting to form a joint, said joints extending from said one other of said peripheral edges.

4. An exterior finish and insulation system as claimed in claim 1 wherein:

said portion of said one other of said peripheral edges extends adjacent to said first face and between contiguous edges to provide an elongate slot in said exterior finish to expose an area of insulation.

5. An exterior insulation and finish system according to claim 4 wherein said one other edge is inclined to said first and second faces.

6. An exterior insulation as claimed in claim 2 wherein:

said exterior finish comprises a curable cement based screed and a mesh embedded therein.

7. An exterior insulation and finish system for application to a wall of a building comprising:

an air barrier having a pair of oppositely directed surfaces, one of which contacts said wall and a second of which is directed outwardly from said wall;

an insulation material having first and second oppositely directed faces, said first face abutting said second surface of said barrier to cover a predetermined area of said wall;

said insulation material being permeable and having peripheral edges extending between said first and second faces and delimiting the area to be covered by said exterior insulation;

an exterior finish applied to said second face, at least one of said peripheral edges and at least part of one other of said edges to inhibit ingress of said moisture into said insulation, so that at least a portion of said one other of said peripheral edges remains uncovered by said exterior finish to permit air to flow into said insulation and equalize pressure across said exterior finish;

said portion of said one other of said peripheral edges extending adjacent to said first face and between contiguous edges to provide an elongate slot in said exterior finish to expose an area of insulation; and said exterior finish comprising a mesh reinforcement extending over said peripheral edges and across said slot to protect said area of insulation.

8. An exterior insulation and finish system for application to a wall of a building comprising:

an air barrier having a pair of oppositely directed surfaces, one of which contacts said wall and a second of which is directed outwardly from said wall;

an insulation material having first and second oppositely directed faces, said first face abutting said second surface of said barrier to cover a predetermined area of said wall;

said insulation material being permeable and having peripheral edges extending between said first and second faces and delimiting the area to be covered by said exterior insulation; and an exterior finish applied to said second face, at least one of said peripheral edges and at least part of one other of said edges to inhibit ingress of said moisture into said insulation, so that at least a portion of said one other of said peripheral edges remains uncovered by said exterior finish to permit air to flow into said insulation and equalize pressure across said exterior finish;

said portion of said one other of said peripheral edges extending adjacent to said first face and between contiguous edges to provide an elongate slot in said exterior finish to expose an area of insulation;

said one other of said peripheral edges being inclined to said first and second faces; and said one other of said peripheral edges intersecting said second face at an acute angle and said exterior finish extending along said one other of said peripheral edges from said second face to said slot.

9. An exterior insulation and finish system as claimed in claim 8 wherein:

said elongate slot has an area greater than 1% of said predetermined area.

10. An exterior insulation and finish system as claimed in claim 8 wherein:

said elongate slot has an area between 1% and 2% of said predetermined area.

11. An exterior insulation and finish system as claimed in claim 8 wherein:

said elongate slot has an area 2% of said predetermined area.

12. An exterior insulation and finish system for application to a wall of a building comprising:

an air barrier having a pair of oppositely directed surfaces, one of which contacts said wall and a second of which is directed outwardly from said wall;

an insulation material having first and second oppositely directed faces, said first face abutting said second surface of said barrier to cover a predetermined area of said wall;

said insulation material being permeable and having peripheral edges extending between said first and second faces and delimiting the area to be covered by said exterior insulation; and an exterior finish applied to said second face, at least one of said peripheral edges and at least part of one other of said edges to inhibit ingress of said moisture into said insulation, so that at least a portion of said one other of said peripheral edges remains uncovered by said exterior finish to permit air to flow into said insulation and equalize pressure across said exterior finish;

said portion of said one other of said peripheral edges extending adjacent to said first face and between contiguous edges to provide an elongate slot in said exterior finish to expose an area of insulation; and an apertured strip covering said slot and secured to said wall.

13. An exterior insulation as claimed in claim 12 wherein:

said strip comprises an angle member having one leg covering said slot and another leg extending between said insulation and said barrier.

* * * * *